US006227455B1

(12) United States Patent
Scott et al.

(10) Patent No.: US 6,227,455 B1
(45) Date of Patent: May 8, 2001

(54) SUB-SURFACE SPRINKLER WITH SURFACE ACCESSIBLE VALVE ACTUATOR COMPONENTS

(75) Inventors: Loren W. Scott, Carlsbad; Phillip A. Hope, Escondido, both of CA (US)

(73) Assignee: Hunter Industries, Inc., San Marcos, CA (US)

( * ) Notice: Subject to any disclaimer, the term of this patent is extended or adjusted under 35 U.S.C. 154(b) by 0 days.

(21) Appl. No.: 09/491,006

(22) Filed: Jan. 25, 2000

Related U.S. Application Data

(63) Continuation-in-part of application No. 09/094,412, filed on Jun. 9, 1998, now abandoned.

(51) Int. Cl.[7] ..... B05B 17/00

(52) U.S. Cl. ..... 239/1; 239/206; 239/263.1; 239/580; 137/15.08

(58) Field of Search ..... 239/200–206, 239/263.1, 264, 288, 571, 580, 585.1, 1; 137/363, 364, 15.08, 15.17

(56) References Cited

U.S. PATENT DOCUMENTS

| | | | |
|---|---|---|---|
| 1,776,455 | 9/1930 | Thompson . | |
| 4,355,197 | 10/1982 | Jönsson | 174/37 |
| 4,729,511 | 3/1988 | Citron | 239/205 |
| 4,781,327 | 11/1988 | Lawson et al. | 239/203 |
| 4,809,910 | 3/1989 | Meyer | 239/1 |
| 4,913,351 | 4/1990 | Costa | 239/74 |
| 5,711,486 | 1/1998 | Clark et al. | 239/205 |
| 5,720,435 | 2/1998 | Hunter | 239/204 |
| 5,762,270 | 6/1998 | Kearby et al. | 239/205 |
| 5,871,156 | 2/1999 | Iawson | 239/201 |
| 5,899,386 | 5/1999 | Miyasato et al. | 239/289 |
| 5,927,607 | 7/1999 | Scott | 239/205 |
| 5,979,482 | 11/1999 | Scott | 137/15 |

*Primary Examiner*—Lisa Ann Douglas
(74) *Attorney, Agent, or Firm*—Michael H. Jester

(57) ABSTRACT

A pop-up sprinkler has a diaphragm-type valve in the lower end thereof which is actuated by a remote pilot valve. The pilot valve may be either solenoid actuated, or hydraulically actuated by a suitable valve actuator component. In a first embodiment an upwardly opening valve actuator component assembly housing communicates with a hollow wire and hose housing. The wire and hose housing connects to the side of the cylindrical outer body of the sprinkler to position a lid of the valve actuator component assembly housing at surface level, but outside a circular ground support flange connected to the sprinkler body. In a second embodiment, the housing is situated so that the lid effectively forms part of the circular ground support flange. The valve actuator component assembly housing may contain, for example, a pilot valve coupled to a solenoid, and a regulator. The pilot valve and regulator are connected through hoses to the sprinkler body. When the solenoid fails it can be easily replaced by opening the lid of the valve actuator component assembly housing and pulling out the solenoid, without having to excavate and remove the sprinkler.

27 Claims, 9 Drawing Sheets

SUB-SURFACE SPRINKLER WITH SURFACE ACCESSIBLE VALVE ACTUATOR COMPONENTS

CROSS-REFERENCE TO RELATED APPLICATION

This application is a continuation-in-part of U.S. patent application Ser. No. 09/094,412 of Loren W. Scott filed Jun. 9, 1998 now abandoned and having the same title.

BACKGROUND OF THE INVENTION

The present invention relates to irrigation equipment, and more particularly, to sprinklers used to irrigate lawns, playing fields, golf courses and the like.

Sprinklers have long been used to water turf and other vegetation. Many designs have been developed with the goal of uniformly distributing a desired precipitation rate over a given area. One of the most common type of sprinklers is the pop-up type that is normally mounted in a subsurface location so that the top of the sprinkler is substantially at ground level. When water pressure is applied a riser with a nozzle at its upper end extends and delivers a spray of water over the adjacent area. When the water pressure is terminated, a spring retracts the riser so that the upper end of the nozzle is flush with the head of the sprinkler. This removes the sprinkler as an obstacle to play occurring on the turf and allows the turf to be mowed.

Pop-up sprinklers having internal water turbines for rotating their nozzles have been developed and widely commercialized. Furthermore, pop-up sprinklers with diaphragm type valves incorporated into the same are widely utilized. A common type of pop-up sprinkler has an internal diaphragm valve which is opened and closed by a solenoid or a hydraulically operated pilot valve. The solenoid and/or. pilot valve components of such valves frequently fail during their normal life cycle. It is then necessary to shut off the water supply and dig up the sprinkler so that the defective components can be repaired, or the sprinkler replaced in its entirety. This is a tedious and time consuming process.

U.S. Pat. No. 5,871,156 of Kenneth L. Lawson granted Feb. 16, 1999, discloses an impact drive sprinkler mounted on a reciprocable riser inside a hollow body having an inlet valve at its lower end. A regulator module is connected to the valve and is suspended beneath a non-circular ground support flange. The non-circular shape of the ground support flange is disfavored by irrigation system installers because a circular turf cut-out made with a conventional tool does not accommodate this sprinkler. In addition, the regulator module must be removed via excavating below the ground support flange, or removing the sprinkler from the ground entirely.

It would be desirable to provide a sub-surface sprinkler with a built-in valve and a valve actuating components that could be more readily serviced without having to dig up the sprinkler.

SUMMARY OF THE INVENTION

It is therefore the primary object of the present invention to provide a sub-surface sprinkler with a built-in valve and valve actuating components that can be more readily serviced without having to dig up the sprinkler.

It is another object of the present invention to provide a sub-surface sprinkler with a built-in valve which is turned ON and OFF by valve actuating components which are positioned so that they can be readily accessed from the surface for repair or replacement.

According to the present invention a sprinkler includes a body having an inlet at its lower end and a nozzle mounted in its upper end. Water communicates within the body from the inlet to the nozzle. A valve is located in the body for admitting water from the inlet into the body. A valve actuator component assembly is mounted in a valve actuator component assembly housing mounted to an exterior of the body. The assembly is connected to the valve and is operable between ON and OFF conditions to open and close the valve. A plurality of hoses connect the valve actuator component assembly and the valve.

The present invention is preferably utilized with a pop-up sprinkler of the type having a diaphragm-type valve in the lower end thereof which is actuated by a remote pilot valve. The pilot valve may be either solenoid actuated, or hydraulically actuated by a suitable valve actuator component. An upwardly opening valve actuator component assembly housing having an openable lid is connected to the sprinkler body. In one form of the invention the valve actuator component assembly housing is positioned adjacent to a circular ground support flange that extends horizontally from the upper end of the sprinkler body. The valve actuator component assembly housing communicates with a hollow wire and hose housing. The wire and hose housing connects to the side of the cylindrical outer housing of the sprinkler to position the lid of the valve actuator component assembly housing at surface level. In another form of the invention the valve actuator component assembly housing is connected to the side of the sprinkler body so that the lid forms part of a ground support flange that extends horizontally from the upper end of the body. The valve actuator component assembly housing may removably contain, for example, a pilot valve coupled to a solenoid, and a regulator. Thus, when the solenoid fails, as is often the case, it can be easily replaced by opening the lid of the valve actuator component assembly housing, without having to dig up the sprinkler.

DESCRIPTION OF THE PREFERRED EMBODIMENT

Figure 1:
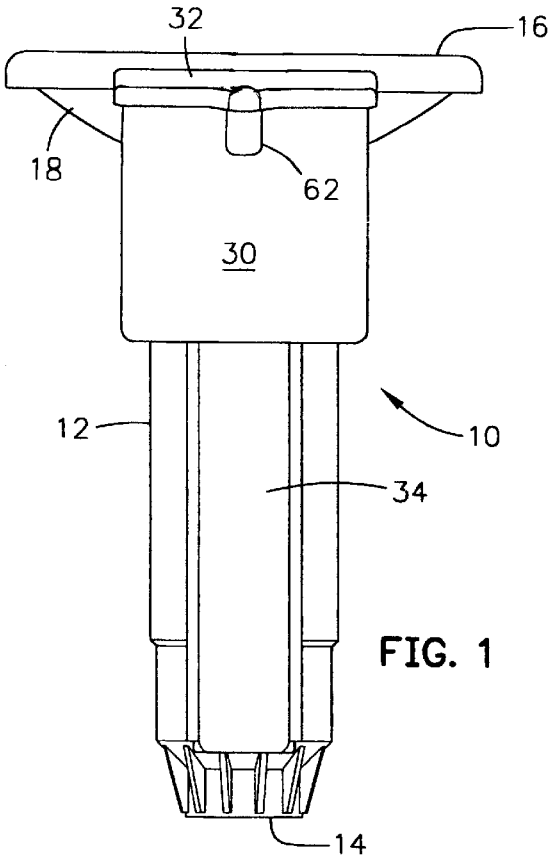
FIG. 1 is a side elevation view of a first embodiment of a pop-up sprinkler incorporating a surface accessible valve component assembly housing in accordance with a preferred embodiment of the present invention.

In accordance with a first embodiment of the present invention a pop-up sprinkler 10 (FIGS. 1–4) has an outer cylindrical hollow body 12 with a female threaded inlet 14 at its lower end. A circular ground support flange 16 extends radially outwardly from an upper end of the sprinkler body 12 in a generally horizontal direction. The ground support flange 16 is supported by circumferentially spaced radially extending fins 18 on the underside thereof. The inlet 14 of the sprinkler body 12 is screwed over a male threaded connector (not shown) of a PVC or other suitable water supply line so that the body 12 is substantially completely mounted in a vertical orientation below the surface 20 (FIG. 2) of the bed of soil in which the sprinkler 10 is planted. The ground support flange 16 is positioned at, or slightly above, the surface 20 of the soil.

A diaphragm valve 22 (FIG. 12) is mounted inside the lower end of the sprinkler body 12 and is actuated by a remote valve actuator component assembly 24 of conventional design. The assembly 24 includes a pilot valve and regulator. The pilot valve may be actuated by a solenoid 25. Alternatively, the pilot valve may be hydraulically actuated by a suitable hydraulic actuator. Pop-up type sprinklers with built in diaphragm valves in their lower ends are well known in the irrigation field. They may be individually turned ON and OFF as opposed to an arrangement where a plurality or block of sprinklers on the same line are simultaneously turned ON and OFF with a single valve. The valve 22 may be a miniaturized version of a stand alone diaphragm valve used in irrigation systems. See U.S. Pat. No. 5,979,482 of Loren W. Scott granted Nov. 9, 1999, the entire disclosure of which is incorporated herein by reference. See also U.S. Pat. No. 5,927,607 of Loren W. Scott granted Jul. 27, 1999, the entire disclosure of which is hereby incorporated by reference.

Figure 12:
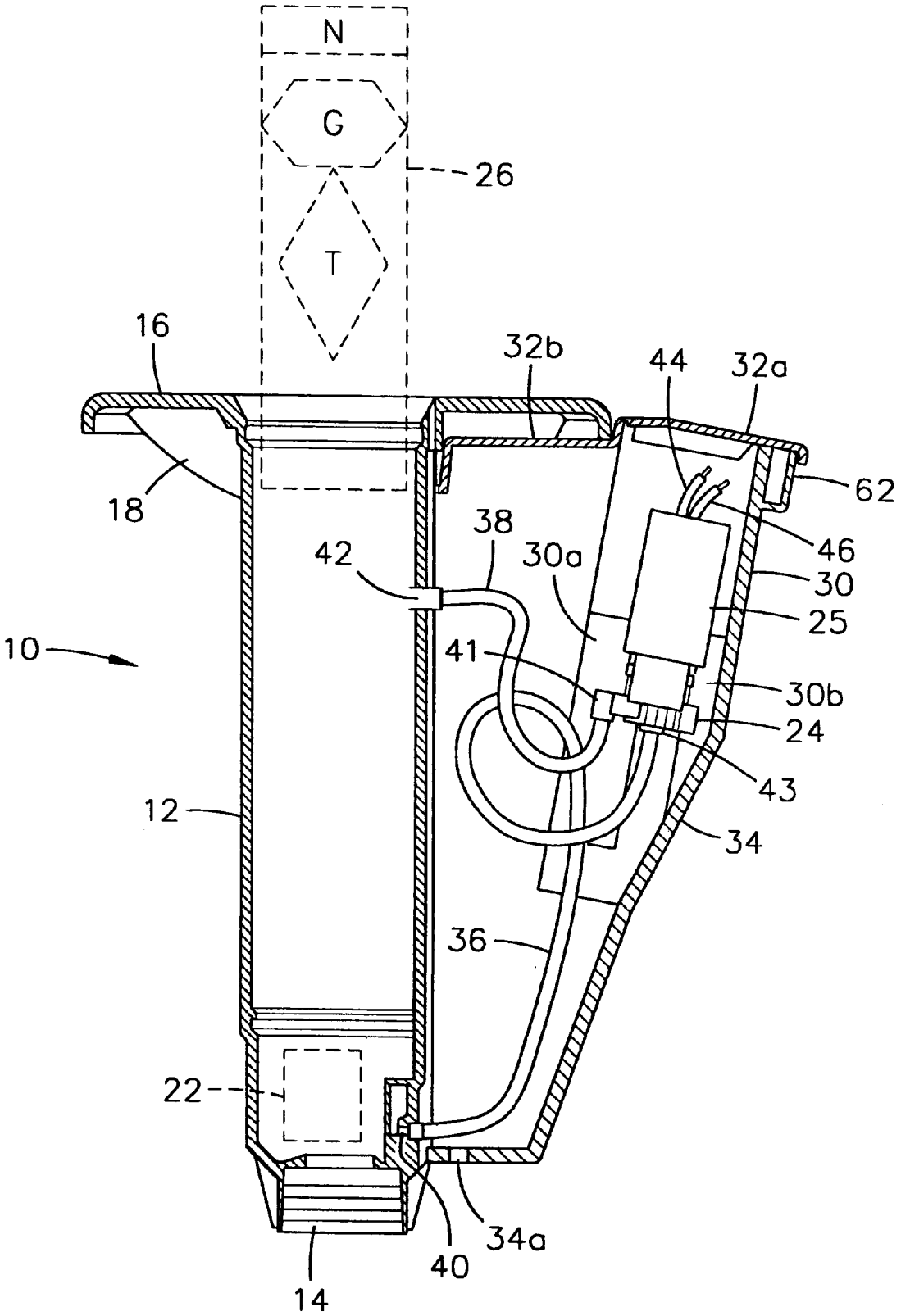
FIG. 12 is an enlarged vertical sectional view of the sprinkler of FIG. 1 showing its riser in phantom lines in an extended position.

As shown in FIG. 12, the sprinkler 10 includes a vertically reciprocable riser 26 that telescopes upwardly and out of the sprinkler body 12 when the valve 22 is opened. The riser 26 slides up and down in the open upper end of the body 12 through a circular opening 28 (FIG. 3) in the grand support Flange 16. The riser 26 retracts under the force of a coil spring (not illustrated) when the valve 22 is closed.

The riser 26 (FIG. 12) incorporates a turbine T and a gear train G in the lower part thereof that rotate a nozzle N at the upper end thereof through an adjustable arc. Such nozzle rotating mechanisms are well known in the art. See for example U.S. Pat. No. 5,720,435 of Richard E. Hunter granted Feb. 24, 1998 and entitled ROTARY SPRINKLER WITH INTERMITTENT GEAR DRIVE, the entire disclosure of which is hereby incorporated by reference. The internal passage inside the riser 26 thus provides a means for communicating the water from inlet 14 to the nozzle N. It will be understood that other passage and port arrangements could provide a means for communicating water from the inlet 14 to the nozzle N. For example, the layout of the water passage connecting the inlet 14 to the nozzle N may be very different for a sprinkler not having a riser. An impact drive spray head with a nozzle that is mounted on a vertically reciprocable riser could be used in place of the rotor-type riser 26. See for example U.S. Pat. No. 5,871,156 granted Feb. 16, 1999.

An upwardly opening valve actuator component assembly housing 30 (FIGS. 1–4) with a hinged lid 32 communicates with a hose housing 34. The hose housing 34 connects to the side of the body 12 of the sprinkler 10 to position the lid 32 at the level of the surface 20 of the soil. The pilot valve and regulator assembly 24 (FIG. 12) are normally positioned within the valve actuator component assembly housing 30 and are connected to hoses 36 and 38. Hoses 36 and 38 couple the pilot valve and regulator assembly 24 to a first connector 40 on the base of the sprinkler body 12 and a second connector 42 higher up on the sprinkler body. The hose 38 also connects to a fitting 41 (FIG. 5) on the pilot valve and regulator assembly 24. The hose 36 also connects to another fitting 43 (FIG. 12) on the pilot valve and regulator assembly 24. The manner in which the pilot valve and regulator assembly 24 control the valve 22 is conventional and need not be further described.

The solenoid 25 is also mounted inside the housing 30 as shown in FIG. 12. The housing 30 has internal structure such as walls 30*a* and 30*b* that position and support the assembly 24 and solenoid 25. Wire leads 44 and 46 are connected to the solenoid 25 and extend down the hose housing 34 and through a hole 34*a* (FIGS. 4 and 11) in the bottom wall thereof. For the sake of clarity, the wire leads 44 and 46 are broken in FIG. 12.

Figure 2:
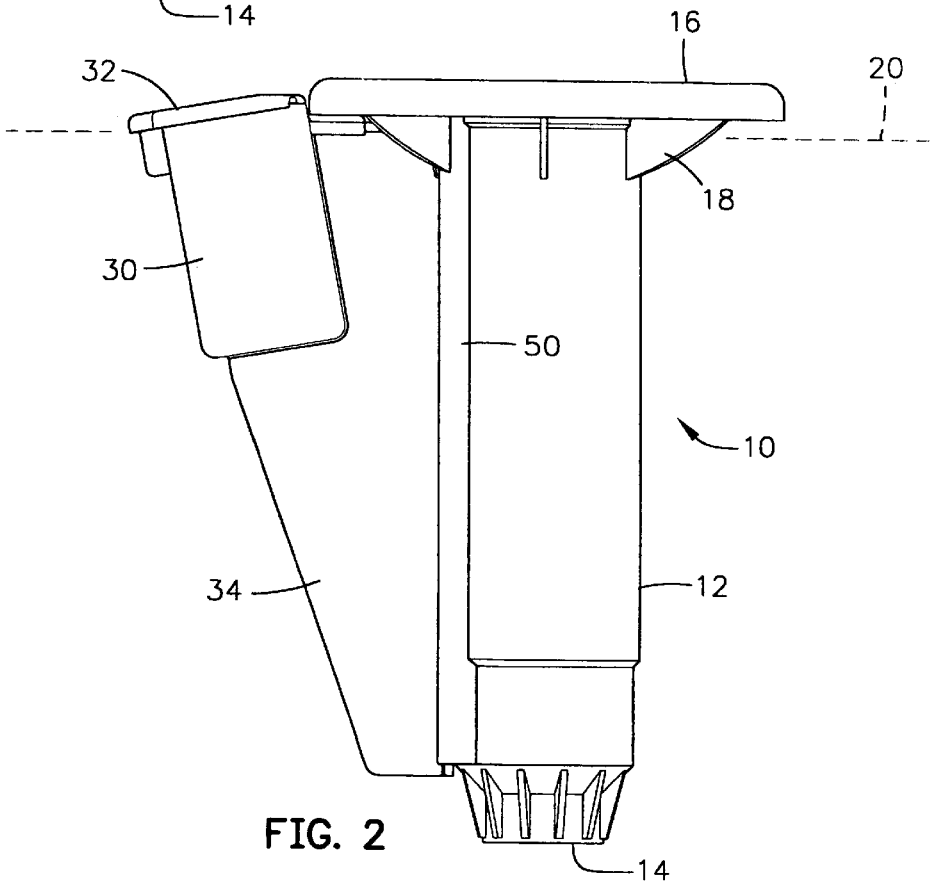
FIG. 2 is a side elevation view of the sprinkler of FIG. 1 rotated ninety degrees about its vertical axis.
Figure 3:
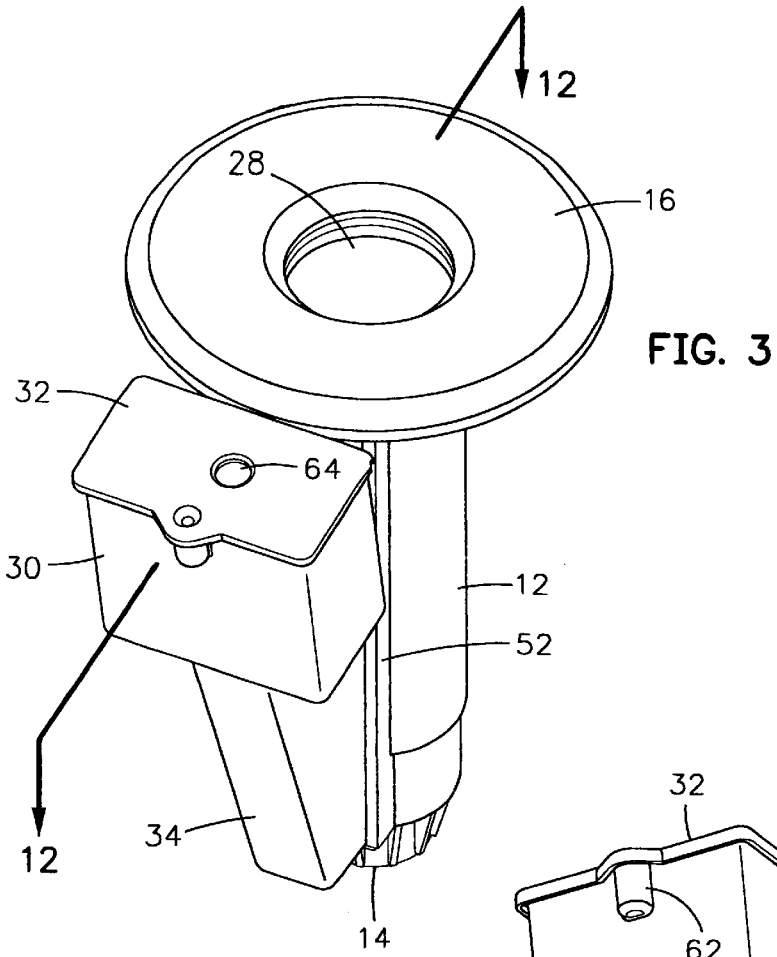
FIG. 3 is an isometric view of the sprinkler of FIG. 1 looking down from above. The riser and its nozzle head have been removed in this view.
Figure 4:
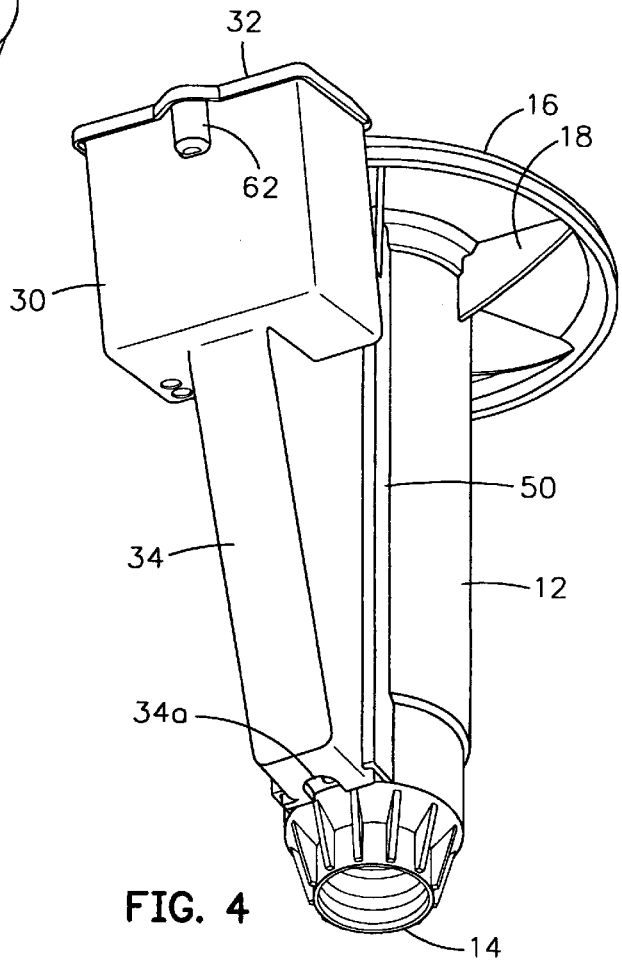
FIG. 4 is an isometric view of the sprinkler of FIG. 1 looking up from below.

As best seen in FIG. 2, the valve actuator component assembly housing 30 is mounted adjacent an upper end of the sprinkler body 12 so that the valve actuator component assembly 24 will be accessible from the surface 20 of a bed of soil in which the sprinkler body 12 is vertically planted. The lid 32 is preferably positioned at substantially the same level as the ground support flange 16. The lid 32 of the valve actuator component assembly housing 30 of the first embodiment is positioned adjacent to, but outside of, the circular ground support flange 16.

Thus, when the solenoid 25 fails, or some other part of the assembly 24 fails, as is often the case, it can be easily replaced by lifting the lid 32 of the valve actuator component assembly housing 30, without having to dig up and remove the entire sprinkler 10.

Figure 13:
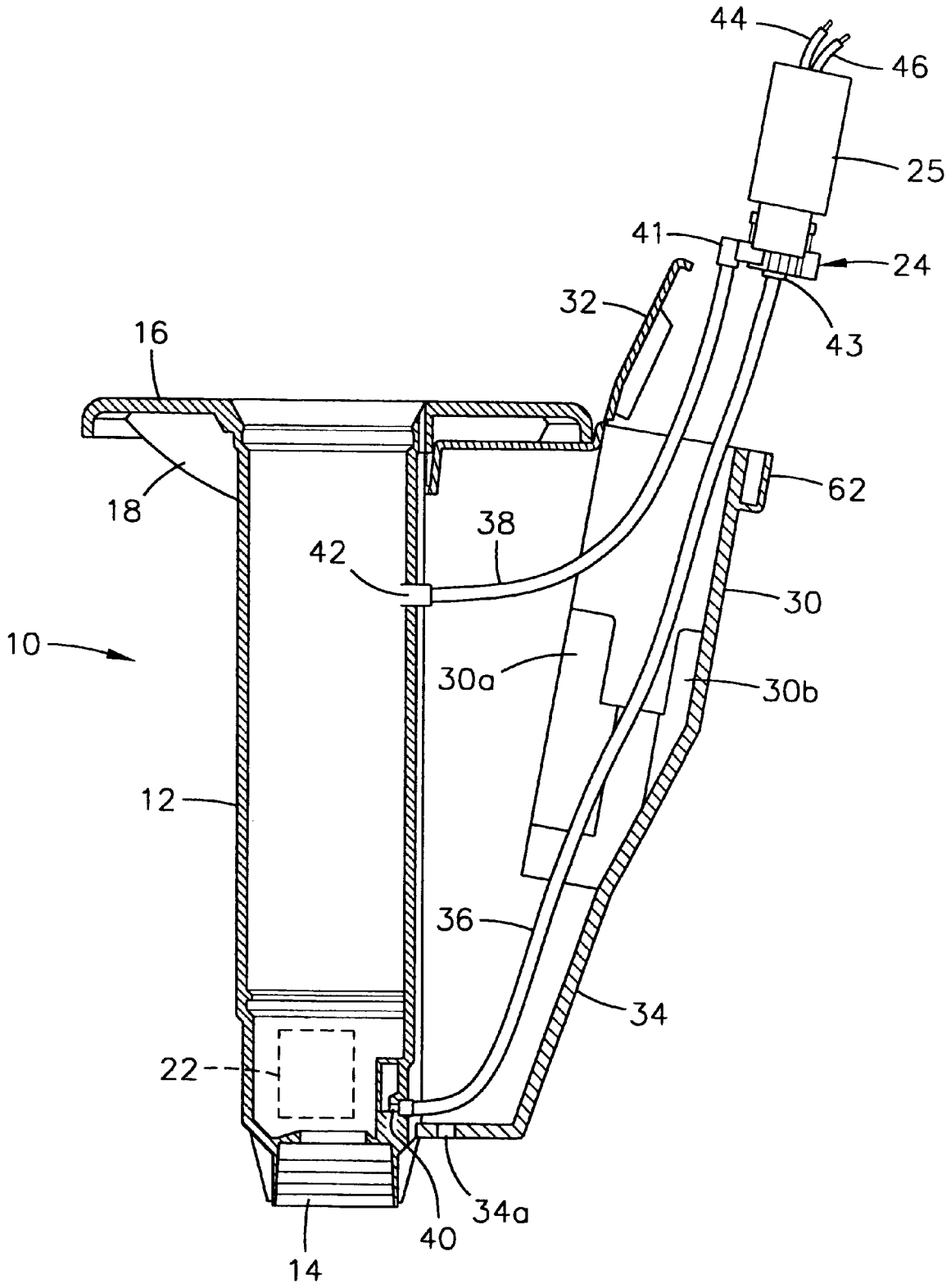
FIG. 13 is an enlarged vertical sectional view similar to FIG. 12 without the riser being illustrated and showing a solenoid and regulator valve assembly removed from the valve component assembly housing.
Figure 14:
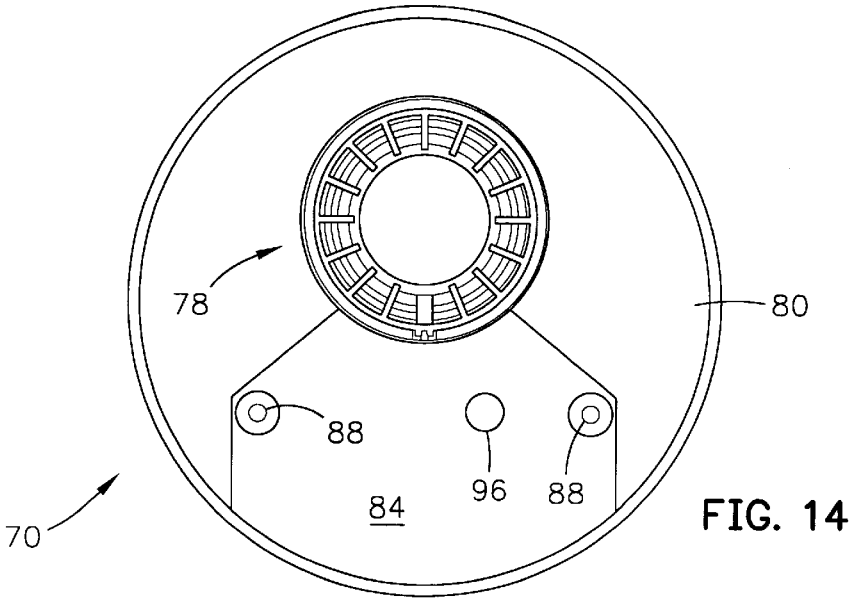
FIG. 14 is a top plan view of an alternate embodiment of a pop-up sprinkler incorporating a surface accessible valve actuator component assembly.
Figure 15:
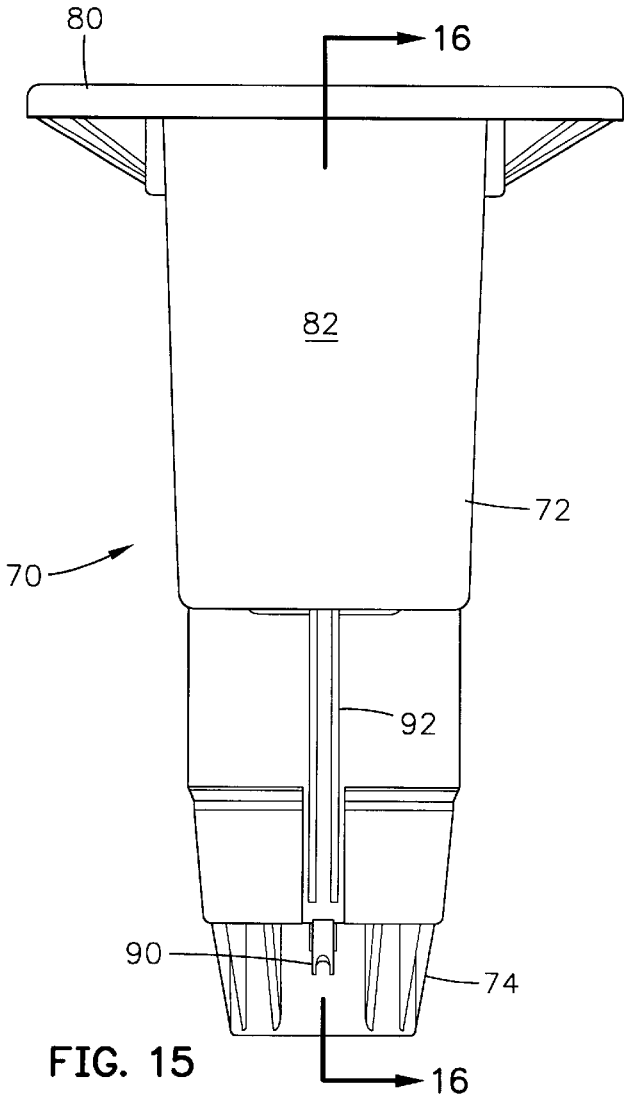
FIG. 15 is a side elevation view of the alternate embodiment taken from the bottom of FIG. 14.
Figure 16:
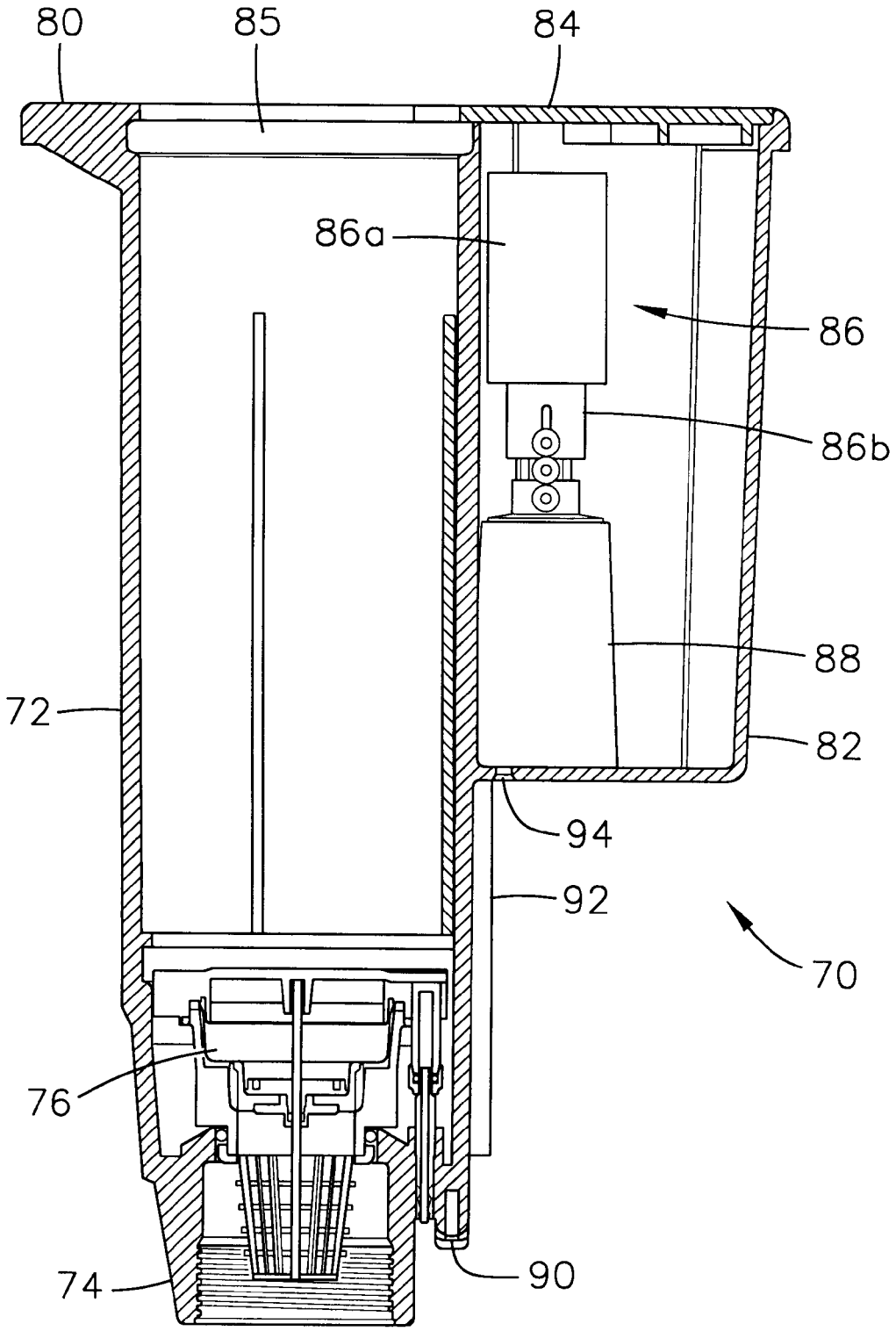
FIG. 16 is a vertical sectional view of the alternate embodiment taken along line 16—16 of FIG. 15.
Figure 17:
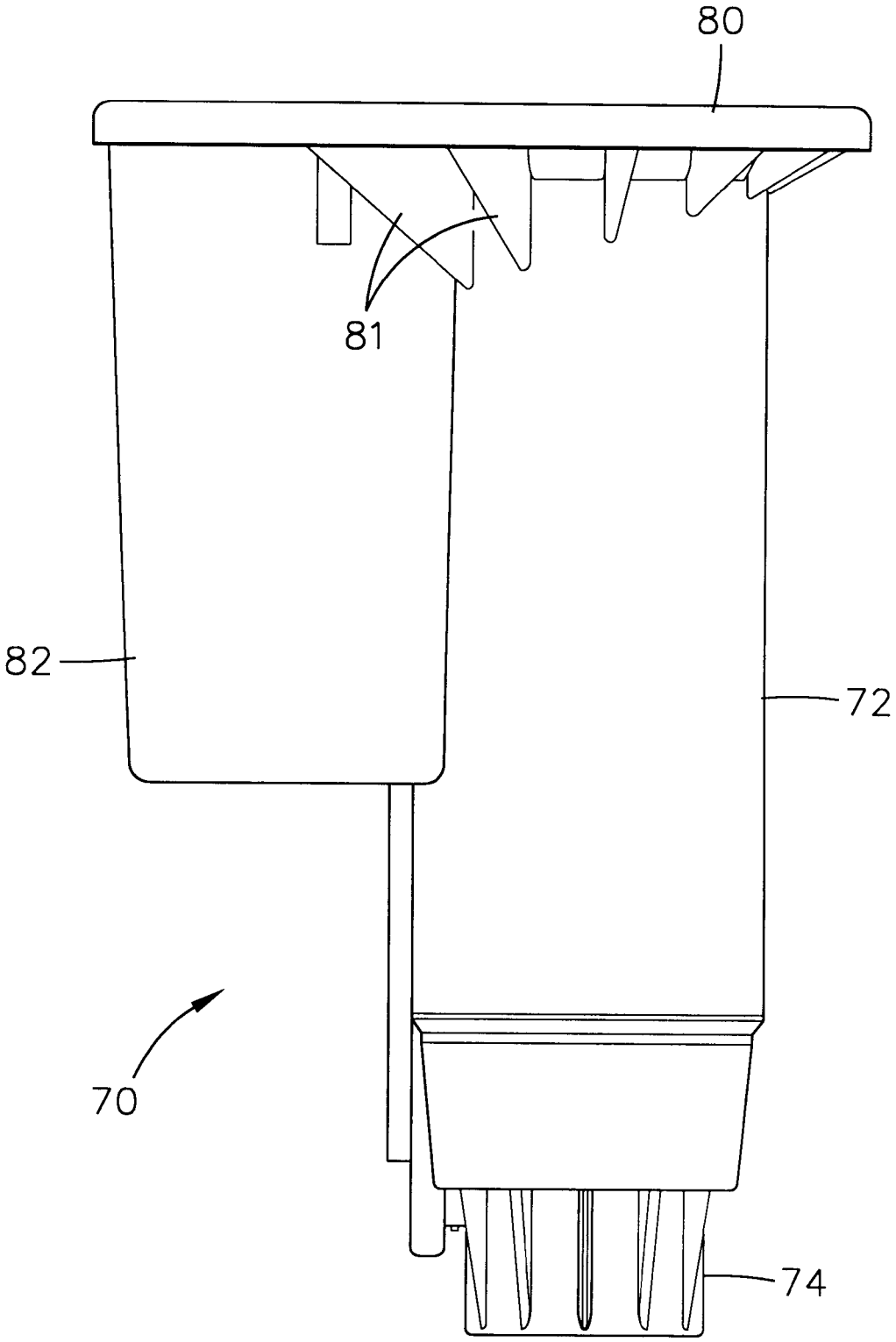
FIG. 17 is a side elevation view of the alternate embodiment taken from the right side of FIG. 14.

FIG. 13 shows the lid 32 lifted to its open position and the pilot valve and regulator assembly 24 along with its attached solenoid 25 removed from the housing 30. The assembly 24 may also be serviced in the same manner. The hoses 36 and 38 and the wire leads 44 and 46 have excess length to allow the assembly 24 and solenoid 25 to be completely pulled out of the housing 30 without disconnecting the same. The shape of the housing 34 ensures that the hoses 36 and 38 do not kink. The housing 34 also protects the hoses 36 and 38 and the wires leads 44 and 46 from damage should excavation around the sprinkler body 12 be necessary.

Figure 5:
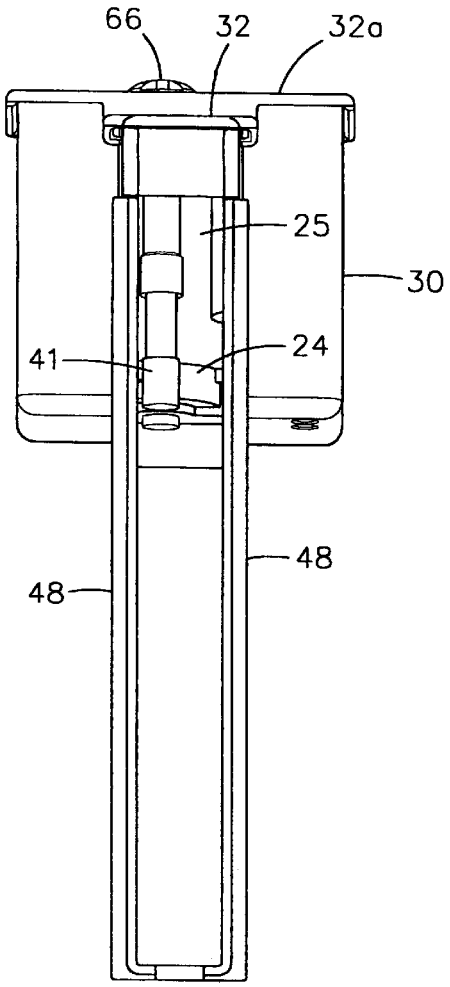
FIG. 5 is an enlarged side elevation view of the valve component assembly housing and hose housing of the sprinkler of FIG. 1.
Figure 6:
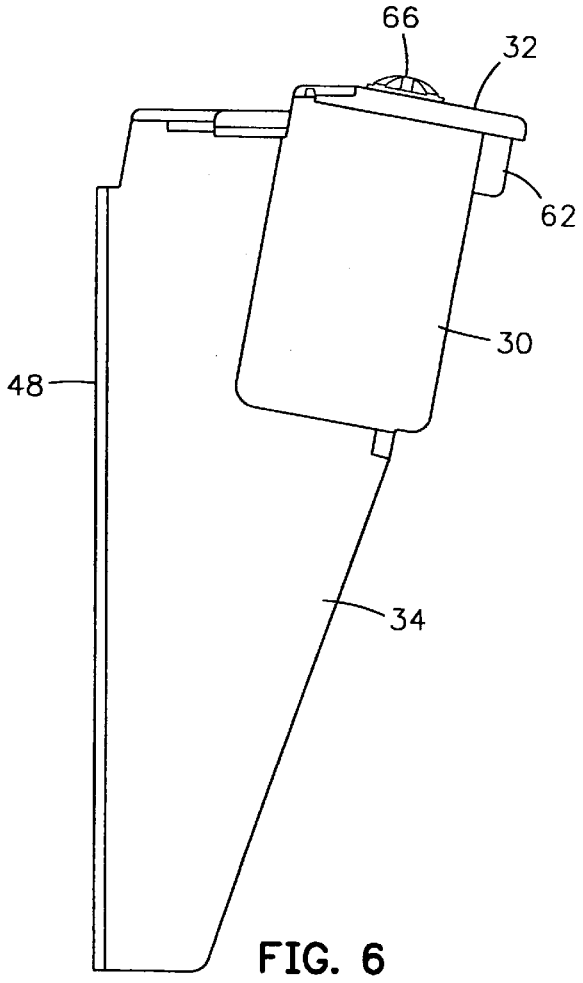
FIG. 6 is an enlarged side elevation view of the valve component housing and hose housing of the sprinkler of FIG. 1 rotated ninety degrees about the vertical axis from the orientation shown in FIG. 5.
Figure 11:
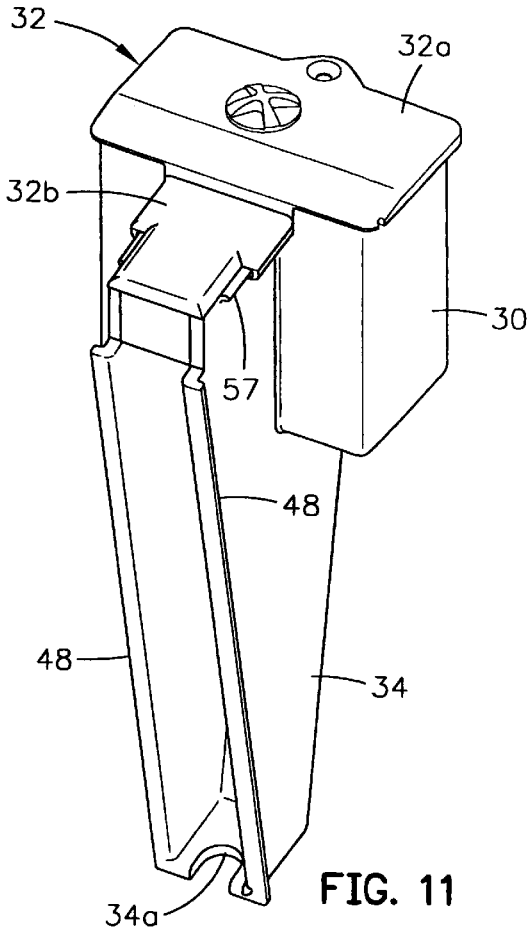
FIG. 11 is an enlarged isometric view of the valve component assembly and hose housing combination of the sprinkler of FIG. 1 taken from the side.

FIGS. 5, 6, 10 and 11 illustrate further details of the housings 30 and 34. The housing 30 is a rectangular box sized to hold the pilot valve and regulator assembly 24 and solenoid 25 as shown in FIG. 12. The hose housing 34 is triangular or wedge-shaped. The lateral width of the hose housing 34 is substantially less than the lateral width of the housing 30. The housing 30 is connected to the upper portion of the hose housing 34 in a T-shaped configuration as best seen in FIG. 5. As seen in FIG. 6, the hose housing 34 tapers downwardly to ease insertion into the soil. The shape of the housing 34 also places the housing 30 outside the flange 16. It includes a pair of L-shaped, longitudinally extending, spaced apart parallel rails 48 (FIG. 11). The rails 48 are slidingly received in corresponding L-shaped, longitudinally extending tracks 50, only one of which is visible in FIGS. 2–4. The L-shaped tracks 50 are connected to, or integrally formed on, the exterior surface of the body 12 of the sprinkler 10 for mating with the rails 48. The housings 30 and 34 are preferably injection molded as a single integral plastic unit that may be slid onto the tracks 50 from the lower end of the body 12. The sprinkler 10 is preferably made of injection molded plastic components. The exterior mounting of the valve actuator component assembly housing 30 and hose housing 34 permits the present invention to be adapted to pop-up sprinklers already being manufactured. The principal modification required is the addition of the tracks 50.

Figure 7:
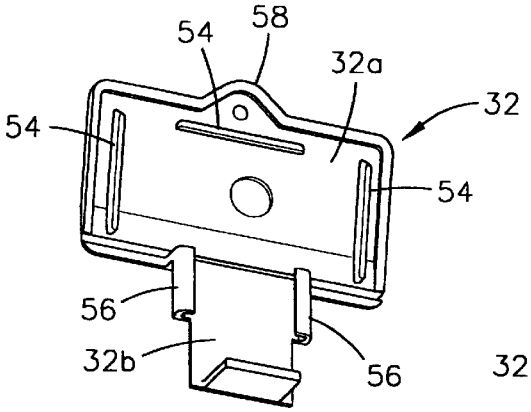
FIG. 7 is an enlarged isometric view of the under side of the lid of the valve component assembly housing of the sprinkler of FIG. 1.
Figure 9:
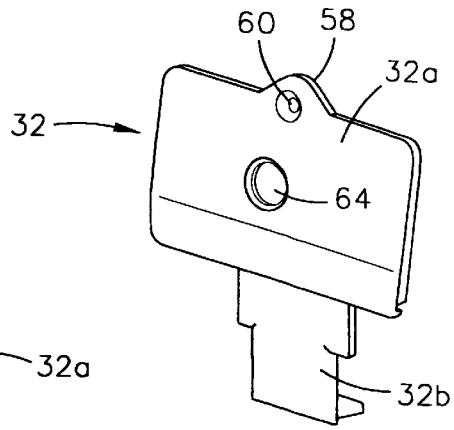
FIG. 9 is an enlarged isometric view of the top side of the lid of the valve component assembly housing of the sprinkler of FIG. 1.
Figure 8:
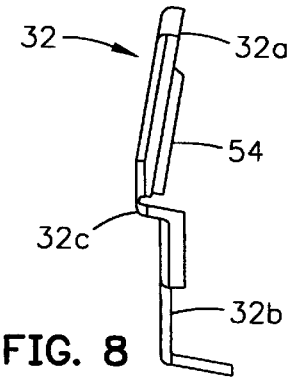
FIG. 8 is a side elevation view of the lid of the lid of the valve component assembly housing of the sprinkler of FIG. 1.
Figure 10:
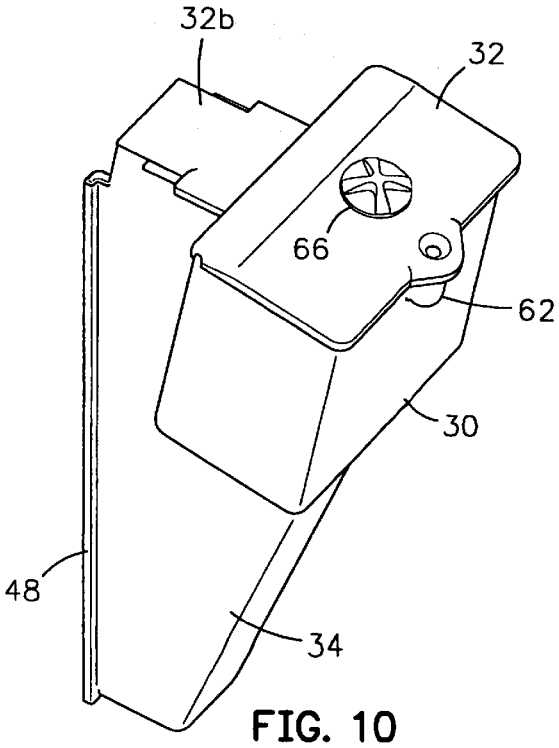
FIG. 10 is an enlarged isometric view of the valve component assembly and hose housing combination of the sprinkler of FIG. 1 taken from above.

FIGS. 7–9 illustrate details of the lid 32 that seals the upwardly opening ends of the housings 30 and 34 The lid 32 includes a major rectangular planar portion 32*a* that seals the upper end of the housing 30 and a minor L-shaped portion 32*b* that seals the portion of the upper end of the hose housing 34 that is not otherwise overlapped by the housing 30. The L-shaped minor portion 32*b* of the lid 32 is glued or otherwise permanently affixed to the upper edges of the side walls of the hose housing 34. As best seen in FIG. 12, the lid portion 32*b* is stepped down below the ground support flange 16. A living hinge portion 32*c* (FIG. 8) of the lid 32 connects the major portion 32*a* and the minor portion 32*b* of the lid 32 to permit the lid 32 to be swung open and closed. The under side of the major portion 32*a* is formed with ribs 54 (FIGS. 7 and 8) to ensure alignment of the same with the upper edges of the housing 30. The under side of the L-shaped minor portion 32*b* is also formed with C-shaped elements 56 that slide over flanges 57 (FIG. 11) formed on the upper edges of the hose housing 34. This allows the lid 32 to be replaced if it should break or wear out. By way of example, the lid 32 may be molded of polyethylene.

A protrusion 58 (FIG. 7) is formed on the forward edge of the major portion 32*a* of the lid 32. The protrusion 58 has a hole 60 for receiving a screw (not shown). The screw threads into a hole in a cylinder 62 (FIGS. 4 and 10) formed on the forward wall of the housing 30. The major portion 32*a* of the lid 32 has a hole 64 (FIG. 3) formed therein that is sealed by a rotatable knob 66. The knob 66 is connected to the upper end of a shaft (not visible) whose lower end is operably connected to the valve actuator component assembly 24. This connection allows manual rotation of the knob 66 to switch the assembly 24 inside the housing 30 between ON, OFF and automatic modes. Alternatively, the knob 66 can be replaced with an elastomeric plug with a criss-cross slit that permits a long cylindrical tool shaft to be inserted therethrough to engage in a slot on the assembly 24 to permit switching of the same.

As best seen in FIGS. 12 and 13 the bottom wall of the housing 30 opens into the hose housing 34 to allow the hoses 36 and 38 and wire leads 44 and 46 to extend between the two housings. Any water that enters the housing 34 can thus drain out of the hole 34*a* (FIG. 11) at the bottom end of the hose housing 34.

FIGS. 14–17 illustrate a second embodiment 70 of a pop-up sprinkler incorporating a surface accessible valve actuator component assembly. The sprinkler 70 includes a vertically extending generally cylindrical hollow body 72 (FIG. 15) having a female threaded inlet 74 (FIG. 16) at its lower end. A valve 76 is located in the lower end of the body 72 for admitting water from the inlet 74 into the interior of the body 72. A riser 78 (FIG. 14) similar to the riser 26 is vertically reciprocable within the interior of the body 72 when the body 72 is connected to a source of pressurized water and the valve 76 is opened and closed. The riser 78 is not illustrated in FIG. 16 but is visible in FIG. 14. A nozzle (not visible) is mounted at an upper end of the riser 78. The riser 78 also contains a water driven turbine (not visible) mounted within the riser 78 and coupled to the nozzle through a gear train (not visible) for rotating the nozzle through an adjustable arc, as described and illustrated with respect to the riser 26 of the previous embodiment.

A circular ground support flange 80 (FIG. 14) extends horizontally and radially outwardly from the upper end of the body 72. The ground support flange 80 has an off-center riser aperture through which the riser 78 extends. The riser aperture is also circular but it is eccentrically located with respect to the circular ground support flange 80. The center of the riser aperture (and the riser 78) is off-set from the center of the ground support flange 80.

A plurality of circumferentially spaced, progressive length fins 81 (FIG. 17) connect the body 72 to the ground support flange 80. A generally rectangular valve actuator component assembly housing 82 (FIGS. 15–17) is attached to an exterior side of the body 72. Preferably the housing 82 is integrally molded to the body 72. The housing 82 has an openable lid 84 (FIGS. 14 and 16) that aligns with, and effectively forms a part of, the ground support flange 80 when the lid 84 is in its closed position illustrated in FIGS. 14 and 16. The lid 84 does not extend beyond the periphery of the circular ground support flange 80. Preferably the groove 85 (FIG. 16) for the snap ring that retains the riser retraction spring extends along the upper end of the outer wall of the housing 82. It is highly desirable that the ground support flange 80 be circular and that the housing 82 not extend beyond the periphery of the flange 80. This allows maintenance personnel to cut a circular hole in turf with conventional equipment to enable the sprinkler 70 to be installed.

A valve actuator component assembly 86 (FIG. 14) is mounted in the valve actuator component assembly housing 82. The assembly 86 is connected via hoses (not illustrated) to the valve 76 for opening and closing the valve 76. The valve actuator component assembly 86 includes a solenoid 86*a* and a pilot valve 86*b*. The pilot valve sits on a top of a shoulder or stand-off 88 molded into the bottom of the housing 82. Preferably the pilot valve 86*b* is locked to the stand-off 88 via a bayonet locking mechanism not visible in FIG. 16. A hose (not illustrated) connects to a fitting 90 (FIG. 16) at the lower end of the body 72 and travels inside a vertical guide track 92. The upper end of this hose enters the housing 82 via hole 94 before being connected to the pilot valve 86*b*. The valve actuator component assembly 86 is readily accessible from above a surface of a bed of soil (not illustrated) in which the body 72 is planted upon moving the lid 84 to an open position. The lid 84 is removable entirely from the sprinkler 70 by removing screws (not illustrated) that are screwed into bores 88. This allows yardage numerals for a golf fairway to be engraved into the lid 84. Alternatively, the lid 84 can be molded with different yardage numerals thereon. A hole 96 (FIG. 14) in the lid 84 allows a tool to be inserted into the housing 82 to engage the assembly 86 to manually turn valve 76 ON and OFF.

Thus the present invention provides a labor saving sprinkler that permits repairs to its valve components to be easily made without having to excavate the sprinkler. In most cases the solenoid and/or pilot valve and regulator component assembly 24 can simply be unplugged and replaced in the field. The defective components can then be repaired in a shop for use in a different sprinkler. The valve actuator component assembly housings 30 and 82 can thus be thought of as service boxes.

While preferred embodiments of our sub-surface sprinkler with surface accessible valve actuator components have been described in detail, it will be understood by those skilled in the art that our invention may be modified in both arrangement and detail. For example, our invention may be used with sprinklers other than the pop-up type. The invention can also be adapted for use with impact drive spray heads. The configuration of the service box can be widely varied. Therefore the protection afforded our invention should only be limited in accordance with the scope of the following claims.

What is claimed is:

1. A method of repairing a valve in a head sprinkler without excavating the sprinkler, comprising the steps of:

providing a hollow body with an inlet and a valve for controlling the entry of water into the body through the inlet;

providing the body with a riser vertically reciprocable within the body and including a nozzle at an upper end thereof for distributing water over an area to be watered;

providing the body with a circular ground support flange at its upper end including an aperture for allowing the riser to extend and retract therethrough and an opening that leads to a valve actuator component assembly housing connected to the body;

installing a valve actuator component assembly inside the housing and operatively connecting the assembly to the valve for turning the valve ON and OFF;

sealing an open upper end of the valve actuator component assembly housing with an openable lid;

connecting the inlet to a sub-surface water supply line;

burying the body in a bed of soil so that the ground support flange is substantially located at a level of a surface of the bed; and opening the lid, disconnecting the assembly, and removing the assembly from the valve actuator component assembly housing through the opening in the ground support flange to enable repair or replacement of the assembly.

2. A sprinkler adapted for sub-surface mounting, comprising:

a body having an inlet at a lower end of the body;

a nozzle mounted in an upper end of the body;

means for communicating water from the inlet to the nozzle;

a valve located in the body for admitting water from the inlet to the water communication means;

a generally rectangular valve actuator component assembly housing attached to an exterior of the body;

a valve actuator component assembly mounted in the valve actuator component assembly housing and connected to the valve, the valve actuator component assembly being operable between ON and OFF conditions to open and close the valve;

means for connecting the valve actuator component assembly and the valve;

the valve actuator component assembly housing being mounted adjacent an upper end of the body so that the valve actuator component assembly will be accessible from a surface of a bed of soil in which the body is planted; and a hose housing connected to the body and to an underside of the valve actuator component assembly housing.

3. The sprinkler of claim 2 wherein the water communicating means includes a riser vertically reciprocable inside the body from a retracted position to an extended position, the nozzle being rotatably mounted on an upper end of the riser.

4. The sprinkler of claim 3 wherein the riser includes a turbine and a gear train connecting the turbine and the nozzle for rotating the nozzle.

5. The sprinkler of claim 2 wherein the valve actuator component assembly housing has a lid movable to cover and uncover an upper opening of the valve actuator component assembly housing.

6. The sprinkler of claim 2 wherein the valve is a diaphragm valve, and the valve actuator component assembly includes a pilot valve and a regulator.

7. The sprinkler of claim 6 wherein the valve actuator component assembly includes a solenoid mounted in the valve actuator component assembly housing for actuating the pilot valve.

8. The sprinkler of claim 2 and further comprising a ground support flange that extends radially outwardly from the upper end of the body.

9. The sprinkler of claim 5 wherein the lid is attached to the valve component assembly housing with a hinge.

10. The sprinkler of claim 5 and further comprising means for securing the lid in a closed position.

11. The sprinkler of claim 8 and further comprising a plurality of radially extending fins connecting the body and the ground support flange.

12. The sprinkler of claim 2 wherein the valve actuator component assembly housing has a box-like configuration.

13. A sprinkler adapted for sub-surface mounting, comprising:

a body having an inlet at a lower end of the body;

a nozzle mounted in an upper end of the body;

means for communicating water from the inlet to the nozzle;

a valve located in the body for admitting water from the inlet to the water communication means;

a valve actuator component assembly housing attached to an exterior of the body;

a valve actuator component assembly mounted in the valve actuator component assembly housing and connected to the valve, the valve actuator component assembly being operable to open and close the valve;

means for connecting the valve actuator component assembly and the valve;

the valve actuator component assembly housing being mounted adjacent an upper end of the body so that the valve actuator component assembly will be accessible from a surface of a bed of soil in which the body is planted; and a hose housing connected to the body adjacent the valve actuator component assembly housing for providing a conduit to enclose the means for connecting the valve actuator component assembly and the valve.

14. The sprinkler of claim 13 wherein the valve actuator component assembly housing is connected to an upper end of the hose housing.

15. The sprinkler of claim 14 wherein the hose housing is removably connected to the body.

16. The sprinkler of claim 15 wherein the hose housing and the body have mating tracks and rails.

17. The sprinkler of claim 13 wherein the hose housing has a hole in a lower wall thereof for draining water.

18. The sprinkler of claim 13 wherein the valve actuator component assembly housing is inclined and is connected to a tapered hose housing that encloses a plurality of hoses.

19. The sprinkler of claim 13 wherein a lateral width of the hose housing is less than a lateral width of the valve actuator component assembly housing.

20. The sprinkler unit of claim 13 wherein the hose housing has a triangular shape.

21. A sprinkler adapted for sub-surface mounting, comprising:

a vertically extending body having an inlet at a lower end of the body;

a valve located in the body for admitting water from the inlet into an interior of the body;

a riser vertically reciprocable within the interior of the body when the inlet is connected to a source of pressurized water and the valve is opened and closed;

a nozzle mounted at an upper end of the riser for distributing the water;

a water driven turbine mounted within the riser and coupled to the nozzle through a gear train for rotating the nozzle through an adjustable arc;

a ground support flange extending horizontally outwardly from an upper end of the body and having an aperture through which the riser can extend;

a valve actuator component assembly housing connected to the ground support flange and having an openable lid that aligns with, and effectively forms a part of, the ground support flange when the lid is in a closed position; and a valve actuator component assembly mounted in the valve actuator component assembly housing and connected to the valve for opening and closing the valve, the valve actuator component assembly being readily removable from the housing from above a surface of a bed of soil in which the body is planted when the lid is in an open position.

22. The sprinkler of claim 21 wherein the ground support flange is round and the aperture through which the riser can extend is located in an off-center position within the ground support flange.

23. The sprinkler of claim 21 wherein the lid of the valve actuator component assembly housing is completely removable.

24. The sprinkler of claim 20 wherein ground support flange is round and the lid of the valve actuator component assembly housing does not extend beyond a periphery of the ground support flange.

25. The sprinkler of claim 21 wherein the ground support flange is round.

26. A sprinkler adapted for sub-surface mounting and above surface repair, comprising:

a vertically extending body having a hollow interior and an inlet;

a valve located in the body for admitting water from the inlet into the interior of the body;

a riser vertically reciprocable within the interior of the body when the inlet is connected to a source of pressurized water and the valve is opened and closed;

a nozzle mounted at an upper end of the riser for distributing the water;

a valve actuator component assembly housing connected to the body and having an open upper end positioned adjacent an upper end of the body;

a generally circular ground support flange extending substantially horizontally outwardly from the upper end of the body and having a riser aperture through which the riser can extend, the open upper end of the valve actuator component assembly housing being located within a circle coinciding with a periphery of the ground support flange; and a valve actuator component assembly mounted inside the valve actuator component assembly housing and operatively connected to the valve for opening and closing the valve, the valve actuator component assembly being disconnectable from the valve and removable through the open upper end of the valve actuator component assembly housing from above a surface of a bed of soil in which the body is planted.

27. A sprinkler adapted for sub-surface mounting, comprising:

a vertically extending body having a hollow interior and an inlet;

a valve located in the body for admitting water from the inlet into the interior of the body;

a riser vertically reciprocable within the interior of the body when the inlet is connected to a source of pressurized water and the valve is opened and closed;

a nozzle mounted at an upper end of the riser for distributing the water;

a circular ground support flange extending horizontally outwardly from an upper end of the body and having a riser aperture through which the riser can extend, a center of the riser aperture being offset from a center of the ground support flange;

a valve actuator component assembly housing integrally connected to an exterior side of the body and having an openable lid that does not extend beyond a periphery of the ground support flange when the lid is in a closed position; and a valve actuator component assembly mounted in the valve actuator component assembly housing and connected to the valve for opening and closing the valve, the valve actuator component assembly being readily removable from above a surface of a bed of soil in which the body is planted upon opening the lid.

* * * * *